US011078045B2

(12) United States Patent
Billard et al.

(10) Patent No.: US 11,078,045 B2
(45) Date of Patent: Aug. 3, 2021

(54) ELECTRONIC SAFETY ACTUATOR FOR LIFTING A SAFETY WEDGE OF AN ELEVATOR

(71) Applicant: OTIS ELEVATOR COMPANY, Farmington, CT (US)

(72) Inventors: Justin Billard, Amston, CT (US); Daryl J. Marvin, Farmington, CT (US); Erik Khzouz, Plainville, CT (US); Marcin Wroblewski, Burlington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 486 days.

(21) Appl. No.: 15/980,418

(22) Filed: May 15, 2018

(65) Prior Publication Data

US 2019/0352127 A1 Nov. 21, 2019

(51) Int. Cl.
*B66B 5/22* (2006.01)
*B66B 5/04* (2006.01)

(52) U.S. Cl.
CPC ..... *B66B 5/22* (2013.01); *B66B 5/044* (2013.01)

(58) Field of Classification Search
CPC ..... B66B 5/22; B66B 5/044
See application file for complete search history.

(56) References Cited

U.S. PATENT DOCUMENTS 6,173,813 B1 * 1/2001 Rebillard ..... B66B 5/06 187/287
7,604,099 B2 10/2009 Kigawa et al.
7,849,975 B2 * 12/2010 Ketonen ..... B66B 13/22 187/394
8,118,140 B2 * 2/2012 Kattainen ..... B66B 13/16 187/391
8,312,972 B2 * 11/2012 Gremaud ..... B66B 5/22 187/372

(Continued)

FOREIGN PATENT DOCUMENTS

CN 101056813 A 10/2007
CN 101535163 A 9/2009

(Continued)

OTHER PUBLICATIONS

Chinese Office Action; International Application No. 20190397921.9; International Filing Date: May 14, 2019; dated Jul. 3, 2020; 9 pages.

(Continued)

*Primary Examiner* — Michael A Riegelman
(74) *Attorney, Agent, or Firm* — Cantor Colburn LLP

(57) ABSTRACT

An electronic safety actuation device for braking an elevator car includes a safety brake movable between a non-braking position and a braking position, a first electronic safety actuator operably coupled to the safety brake via a first link member, and a second electronic safety actuator operably coupled to the safety brake via a second link member. Operation of the first electronic safety actuator applies a force to the first link member to move the safety brake from the non-braking position to the braking position. Operation of the second electronic safety actuator applies a force to the second link member to move the safety brake from the non-braking position to the braking position.

10 Claims, 9 Drawing Sheets

(56) References Cited

U.S. PATENT DOCUMENTS

| | | | | |
|---|---|---|---|---|
| 8,413,765 | B2 * | 4/2013 | Stratmann | B66B 5/0031 187/247 |
| 8,418,813 | B2 * | 4/2013 | Yim | B66B 13/22 187/247 |
| 8,430,212 | B2 * | 4/2013 | Ueda | B66B 5/02 187/391 |
| 9,457,989 | B2 * | 10/2016 | Meierhans | B66B 5/18 |
| 2008/0296098 | A1 * | 12/2008 | Sato | B66B 5/22 187/376 |
| 2011/0088983 | A1 * | 4/2011 | Sirigu | B66B 5/22 187/373 |
| 2012/0222918 | A1 * | 9/2012 | Billard | B66B 5/22 187/359 |
| 2013/0118836 | A1 * | 5/2013 | Rossignol | B66B 5/0031 187/247 |
| 2014/0008157 | A1 * | 1/2014 | Terry | B66B 5/22 187/359 |
| 2015/0251878 | A1 * | 9/2015 | Legeret | B66B 5/18 187/359 |
| 2015/0321883 | A1 * | 11/2015 | Husmann | B66B 5/20 187/374 |
| 2016/0200549 | A1 * | 7/2016 | Billard | B66B 5/24 188/65.1 |
| 2016/0236904 | A1 * | 8/2016 | Witczak | B66B 5/22 |
| 2017/0001835 | A1 * | 1/2017 | Hu | F16D 65/16 |
| 2017/0066627 | A1 * | 3/2017 | Hu | B66B 5/18 |
| 2017/0073189 | A1 * | 3/2017 | Dube | B66B 9/00 |
| 2017/0233221 | A1 * | 8/2017 | Geisshusler | B66B 5/0031 187/247 |
| 2017/0283215 | A1 * | 10/2017 | Hu | B66B 5/22 |
| 2017/0283216 | A1 * | 10/2017 | Marvin | B66B 5/0031 |
| 2017/0283217 | A1 * | 10/2017 | Marvin | B66B 5/0031 |
| 2017/0291797 | A1 * | 10/2017 | Hu | B66B 5/22 |
| 2017/0291798 | A1 * | 10/2017 | Hu | B66B 5/22 |
| 2018/0222717 | A1 * | 8/2018 | Billard | B66B 5/18 |
| 2018/0222718 | A1 * | 8/2018 | Khzouz | B66B 5/18 |
| 2018/0327224 | A1 * | 11/2018 | Billard | B66B 5/22 |
| 2019/0062113 | A1 * | 2/2019 | Hu | B66B 5/18 |
| 2019/0186573 | A1 * | 6/2019 | Manes | F16F 1/187 |
| 2019/0300331 | A1 * | 10/2019 | Sudi | B66B 5/0037 |
| 2019/0345002 | A1 * | 11/2019 | Wroblewski | B66B 5/18 |
| 2019/0352127 | A1 * | 11/2019 | Billard | B66B 5/044 |
| 2020/0031621 | A1 * | 1/2020 | Khzouz | B66B 5/22 |

FOREIGN PATENT DOCUMENTS

| | | | |
|---|---|---|---|
| CN | 102874669 | A | 1/2013 |
| CN | 205132808 | U | 4/2016 |
| CN | 107848750 | A | 3/2018 |
| EP | 1939125 | A1 | 7/2008 |
| EP | 3112305 | A1 | 1/2017 |
| EP | 3225578 | A1 | 10/2017 |

OTHER PUBLICATIONS

Extended European Search Report; International Application No. 19174493.7; International Filing Date: May 14, 2019; dated Oct. 11, 2019; 10 pages.

Second Office Action; Chinese Application No. 201910397921.9; International Filing Date: May 14, 2019; dated Feb. 10, 2021; 16 pages with translation.

* cited by examiner

ELECTRONIC SAFETY ACTUATOR FOR LIFTING A SAFETY WEDGE OF AN ELEVATOR

BACKGROUND

Embodiments of the present disclosure relate to elevator systems, and more particularly, to a braking device for use in an elevator system that is operable to aid in braking a hoisted object relative to a guide member.

Hoisting systems (e.g. elevator systems, crane systems) often include a hoisted object, such as an elevator car, a counterweight, a tension member (i.e. a rope or belt) that connects the hoisted object and the counterweight, and a sheave that contacts the tension member. During operation of such hoisting systems, the sheave may be driven (e.g. by a machine) to selectively move the hoisted object and the counterweight. Hoisting systems often include braking devices that aid in braking (i.e. slowing and/or stopping movement of) the hoisted object relative to a guide member, such as a rail or wire for example.

As the rise of buildings increase, it is desirable to similarly increase the travel speed of the elevator car to minimize total travel time. As the speed of the car increases, larger braking devices are required to overcome the forces acting on the elevator car. As a result, a greater force is required to operate the braking devices, such as to move the safety wedges into frictional engagement with a guide member.

BRIEF DESCRIPTION

According to an embodiment, an electronic safety actuation device for braking an elevator car includes a safety brake movable between a non-braking position and a braking position, a first electronic safety actuator operably coupled to the safety brake via a first link member, and a second electronic safety actuator operably coupled to the safety brake via a second link member. Operation of the first electronic safety actuator applies a force to the first link member to move the safety brake from the non-braking position to the braking position. Operation of the second electronic safety actuator applies a force to the second link member to move the safety brake from the non-braking position to the braking position.

In addition to one or more of the features described above, or as an alternative, in further embodiments the first link member and the second link member are independently coupled to the safety brake.

In addition to one or more of the features described above, or as an alternative, in further embodiments the second link member is coupled to the safety brake via the first link member.

In addition to one or more of the features described above, or as an alternative, in further embodiments the first link member and the second link member are connected via a pin and slot engagement.

In addition to one or more of the features described above, or as an alternative, in further embodiments the first link member is movable relative to the second link member to move the safety brake from the non-braking position to the braking position.

In addition to one or more of the features described above, or as an alternative, in further embodiments the second link member is configured to move in conjunction with the first link member to move the safety brake from the non-braking position to the braking position.

In addition to one or more of the features described above, or as an alternative, in further embodiments the first link member and the second link member are integrally formed.

In addition to one or more of the features described above, or as an alternative, in further embodiments the first electronic safety actuator and the second electronic safety actuator are integrally formed as a single unit.

In addition to one or more of the features described above, or as an alternative, in further embodiments the first electronic safety actuator includes a first housing and the second electronic safety actuator includes a second housing, separate from the first housing.

In addition to one or more of the features described above, or as an alternative, in further embodiments at least one of the first electronic safety actuator and the second electronic safety actuator is integrally formed with the safety brake as a single unit.

In addition to one or more of the features described above, or as an alternative, in further embodiments the first electronic safety actuator further comprises a magnetic brake operably coupled to the first link member, the magnetic brake being movable between a first position and a second position and an electromagnetic component configured to hold the magnetic brake in one of the first position and the second position.

In addition to one or more of the features described above, or as an alternative, in further embodiments the safety brake includes a wedge having a contact surface, the wedge being movable between the non-braking position and the braking position.

According to another embodiment, a method of operating an electronic safety actuation device to brake movement of an elevator car includes detecting an overspeed condition of the elevator car, actuating a first electronic safety actuator to move a safety brake from a non-braking position to a braking position, and upon detecting a failure of the first electronic safety actuator, actuating a second electronic safety actuator to move a safety brake from a non-braking position to a braking position.

In addition to one or more of the features described above, or as an alternative, in further embodiments a controller is operable to actuate the first electronic safety actuator and the second electronic safety actuator.

In addition to one or more of the features described above, or as an alternative, in further embodiments the controller actuates the first electronic safety actuator in response to receiving a signal indicating the overspeed condition.

In addition to one or more of the features described above, or as an alternative, in further embodiments the controller is configured to detect the overspeed condition of the elevator car.

In addition to one or more of the features described above, or as an alternative, in further embodiments actuating the first electronic safety actuator includes applying a force to a link member extending between the first electronic safety actuator and the safety brake.

In addition to one or more of the features described above, or as an alternative, in further embodiments actuating the second electronic safety actuator includes applying a force to a link member extending between the second electronic safety actuator and the safety brake.

In addition to one or more of the features described above, or as an alternative, in further embodiments actuating the second electronic safety actuator includes transmitting a force from a link member coupled to the second electronic safety actuator to the safety brake via an intermediate link member coupled to the link member and the safety brake.

In addition to one or more of the features described above, or as an alternative, in further embodiments the link member and the intermediate link member are connected via a pin and slot engagement.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Figure 1:
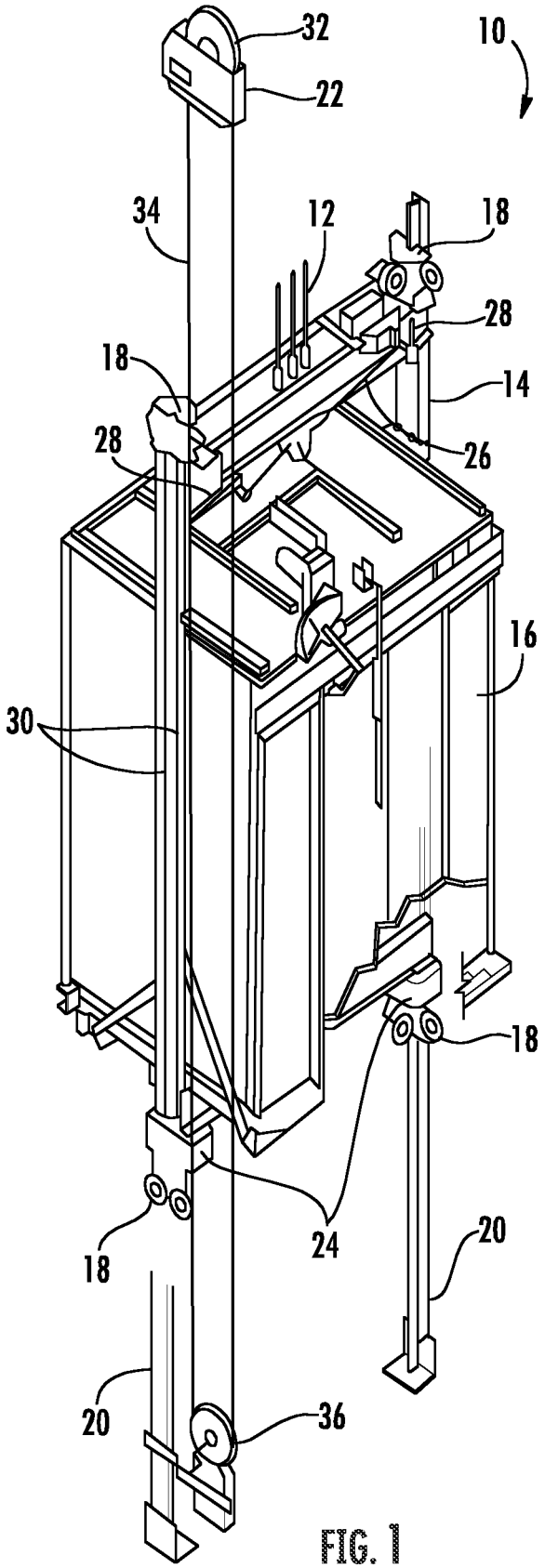
FIG. 1 is a perspective view of an example of an elevator system.

With reference now to FIG. 1, an example of an elevator system, indicated by numeral 10, is illustrated. The elevator system includes tension members 12, a car frame 14, an elevator car 16, roller guides 18, guide rails 20, a governor 22, safeties 24, linkages 26, levers 28, and lift rods 30. The governor 22 includes a governor sheave 32, a rope loop 34, and a tensioning sheave 36. Tension members are connected to the car frame and a counterweight (not shown) within a hoistway. The car, which is attached to the car frame 14, is movable within the hoistway by a force transmitted through the tension members 12 to the car frame 14 by an elevator drive (not shown), commonly located at the top or bottom of the hoistway. Roller guides 18, attached to the car frame 14, guide movement of the elevator car 16 along the guide rails 20, vertically up and down within the hoistway. In an embodiment, the governor sheave 32 is mounted at an upper end of the hoistway and the tensioning sheave 36 is located at a lower end of the hoistway, and the rope loop wraps at least partially about both the governor sheave 32 and the tensioning sheave 36. The rope loop is also connected to the elevator car 16, such as via lever 28, ensuring that the angular velocity of the governor sheave is directly related to the speed of the elevator car 16.

In the illustrated, non-limiting embodiment of an elevator system 10, the governor 22, electromechanical brake (not shown), and safeties 24 cooperate to stop movement of the elevator car 16 if the speed of the elevator car 16 exceeds a threshold as the car 16 moves within the hoistway. If the car 16 reaches an over-speed condition, the governor 22 is triggered initially to engage a switch, which in turn cuts power to the elevator drive, thereby causing the machine brake to drop and arrest movement of the drive sheave, and thereby the car 16. If, however, the tensioning members 12 break, the car 16 otherwise experiences a free-fall condition unaffected by the machine brake, or the machine brake is otherwise ineffective, the governor 22 may then engage the safeties 24 to stop movement of the elevator car. The governor 22 is operable to release a clutching device (not shown) that grips the governor rope 34. The governor rope 34 is connected to the safeties 24 through mechanical linkages 26, levers 28, and lift rods 30. If the car continues to descend, unaffected by the engaged brake, the governor rope 34 applies a force to the operating lever 28, which in turn "sets" the safeties 24 by moving linkages 26 connected to lift rods 30, which cause the safeties to engage the guide rails 20 and bring the car 16 to a stop.

Figure 2:
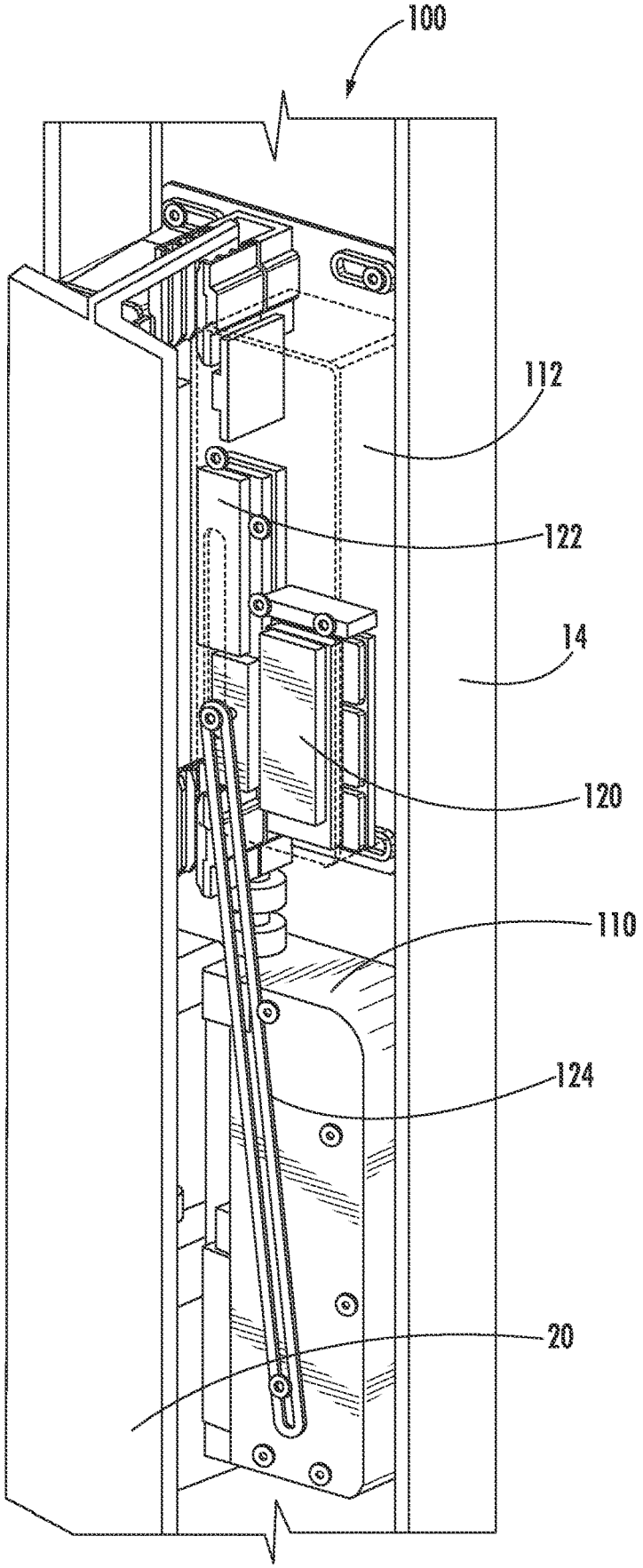
FIG. 2 is a perspective view of an electronic safety actuation device mounted adjacent a guide rail of an elevator system according to an embodiment.
Figure 3:
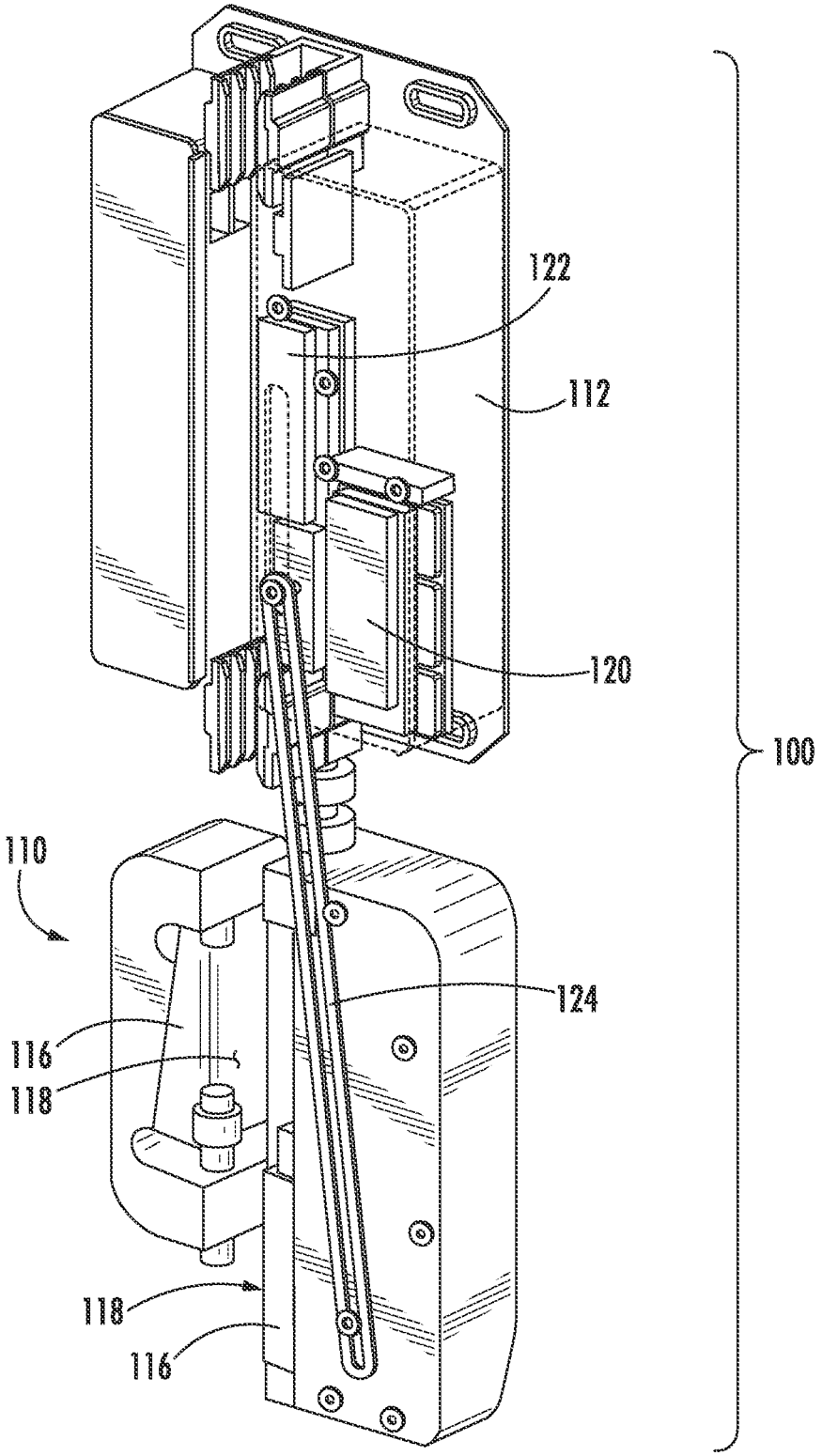
FIG. 3 is another perspective view of an electronic safety actuation device of an elevator system according to an embodiment.

Mechanical speed governor systems, such as described with respect to FIG. 1, are being replaced in some elevators by electronic systems referred to herein as "electronic safety actuators." Referring now to FIGS. 2-3, various examples of an electronic safety actuation device also referred to herein as a safety assembly 100 suitable for actuating and resetting a safety brake, such as safety brake 24 of elevator system 10 for example, are illustrated. The safety assembly 100 includes a safety brake 110 and at least one electronic safety actuator 112 that is operatively coupled to an elevator car, such as car 16 for example. The safety brake 110 may, but need not be similar or identical to the safety brake 24 of the elevator system 10 of FIG. 1. In some embodiments, the safety brake 110 and the electronic safety actuator 112 are mounted to a car frame 14 of the elevator car 16.

The safety brake 110 includes a movable brake member 116, such as a brake pad or a similar structure suitable for repeatable braking engagement with the guide rail 20. As shown, the brake member 116 has a contact surface 118 that is operable to frictionally engage the guide rail 20. The brake member 116 can be arranged in various different arrangements, including, but not limited to, wedge-brake configurations, magnetic-brake configurations, etc., as will be appreciated by those of skill in the art. Although the safety brake 110 illustrated in FIG. 3 is shown having two movable members 116, in other embodiments, a safety brake 110 having only a single movable member 116 configured to contact either side of the guide rail 20 is also within the scope of the disclosure.

The safety brake 110 is movable between a non-braking position and a braking position. During normal operation of the elevator car 16, the safety brake 110 is disposed in the non-braking position. In particular, when arranged in the non-braking position, the contact surface 118 of the brake member 116 is not in contact with, or is in minimal contact with the guide rail 20, and thus does not frictionally engage the guide rail 20. In the braking position, however, the contact surface 118 is in direct and intentional contact with the guide rail. As a result of this engagement, the frictional force between the contact surface 118 of the brake member 116 and the guide rail 20 is sufficient to stop movement of the elevator car 16 relative to the guide rail 20.

In the illustrated, non-limiting embodiment, an example of an electronic safety actuator 112 includes an electromagnetic component 120 and a magnetic brake 122. Various configurations of the electromagnetic component 120 and magnetic brake 122, are contemplated herein. In an embodiment, the electronic safety actuator 112 has a configuration as set forth in U.S. Provisional Patent Application Ser. No. 62/255,140, filed on Nov. 20, 2106, the entire contents of which is incorporated herein by reference. Further, the electronic safety actuator 112 may be separate from the electronic safety brake 110, or alternatively, may be integrally formed with the electronic safety brake 110 as a single unit.

Various triggering mechanisms or components may be employed to actuate the safety brake 110 and thereby move the contact surface 118 of the brake member 116 from the non-braking position to the braking position, into frictional engagement with the guide rail 20. In the illustrated embodiment, one or more link members 124 operably couple the electronic safety actuator 112 to the safety brake 110. In operation, movement of the link member 124 is caused by activation of the ESA 112, which thereby triggers a corresponding movement of the brake member 116 of the safety brake 110 from the non-braking position to the braking position. As a result, the force transmitted from the safety actuator 112 to the safety brake 110 via the link member 124 enables emergency stopping of the elevator car 16.

Various types of link members 124 are within the scope of the disclosure. In an embodiment, best shown in FIGS. 4-7, the link member 124 is a generally rectangular connectors, such as formed from a relatively thin metal for example. Alternatively, the link member 124 may be a wire (FIG. 8). In yet another embodiment, the link member 124 may include a sheet metal linkage (FIG. 9A) having one or more slots or windows formed therein. It should be understood that the link members 124 illustrated and described herein are intended as examples only, and that any suitable component configured to operably couple a safety actuator 112 to the safety brake 110 is within the scope of the disclosure.

With specific reference now to FIGS. 4-9, in an embodiment, the safety assembly 100 includes a plurality of electronic safety actuators 112 operably coupled to a single safety brake 110. Although two electronic safety actuators, 112*a* and 112*b*, are shown in the various embodiments of the FIGS., a safety assembly 100 having more than two safety actuators 112 is also within the scope of the disclosure. As shown, the operational configuration or construction of the plurality of electronic safety actuators 112 associated with a safety brake 110 may be substantially identical; however, in other embodiments, the plurality of electronic safety actuators 112 associated with a safety brake 110 may have different or distinct operational configurations.

Figure 4:
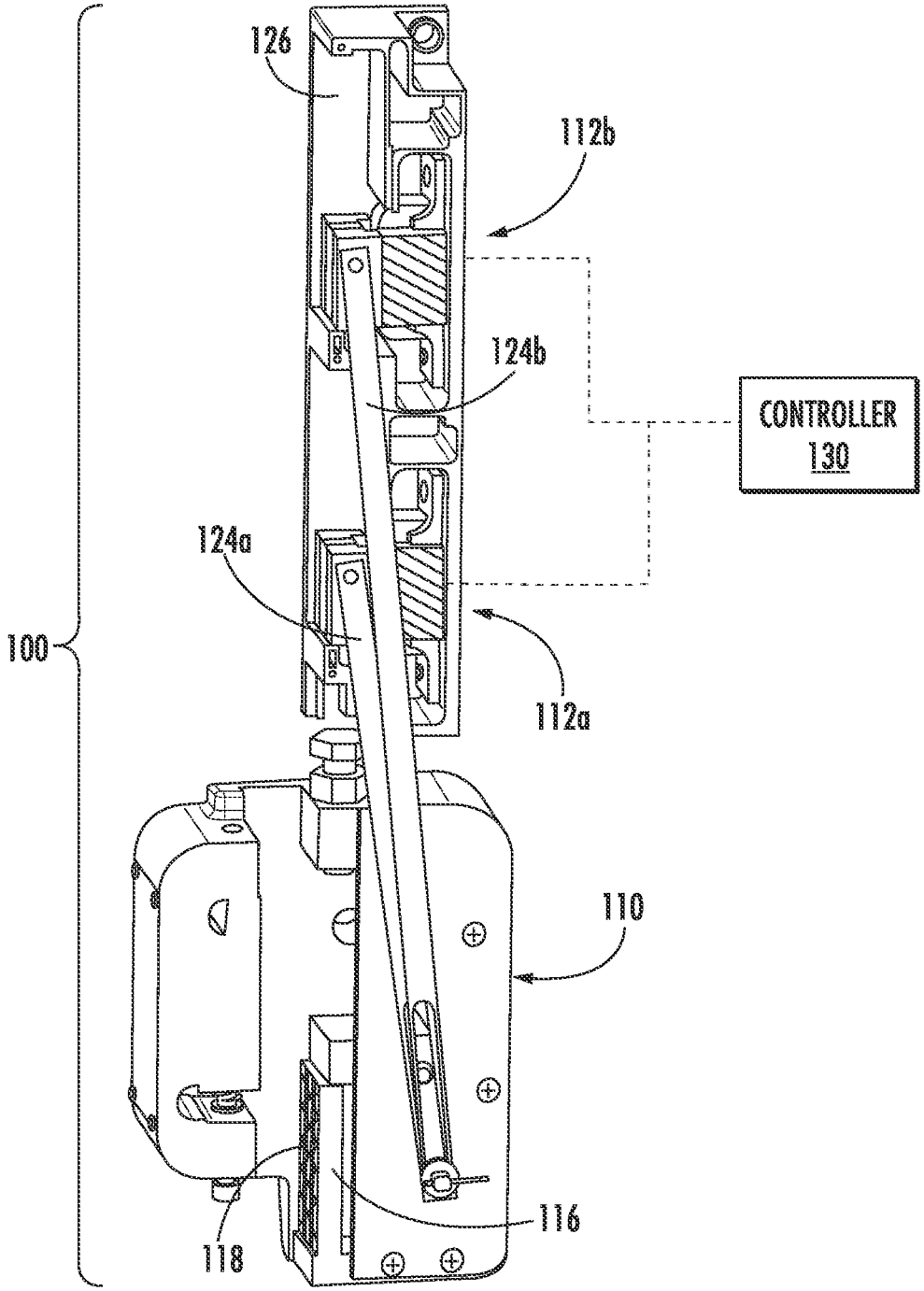
FIG. 4 is a perspective view of an electronic safety actuation device including multiple electronic safety actuators according to an embodiment.

The multiple electronic safety actuators 112 may be combined into a single unit. For example, as shown in FIG. 4 and FIG. 6, the plurality of electronic safety actuators 112*a*, 112*b* are vertically stacked relative to the axial length of the guide rail 20 (not shown), and mounted to a singular housing 126. In other embodiments, best shown in FIGS. 5 and 7, one or more of the plurality of electronic safety actuators 112*a*, 112*b* operably coupled to a safety brake 110 has a separate housing 126*a*, 126*b*, and is mounted individually, as a plurality of distinct safety actuator units. Regardless of whether the plurality of electronic safety actuators 112 are arranged as a single unit or multiple units, one or more of the electronic safety actuators 112 may be formed as a single unit with the electronic safety brake 110.

Figure 9B:
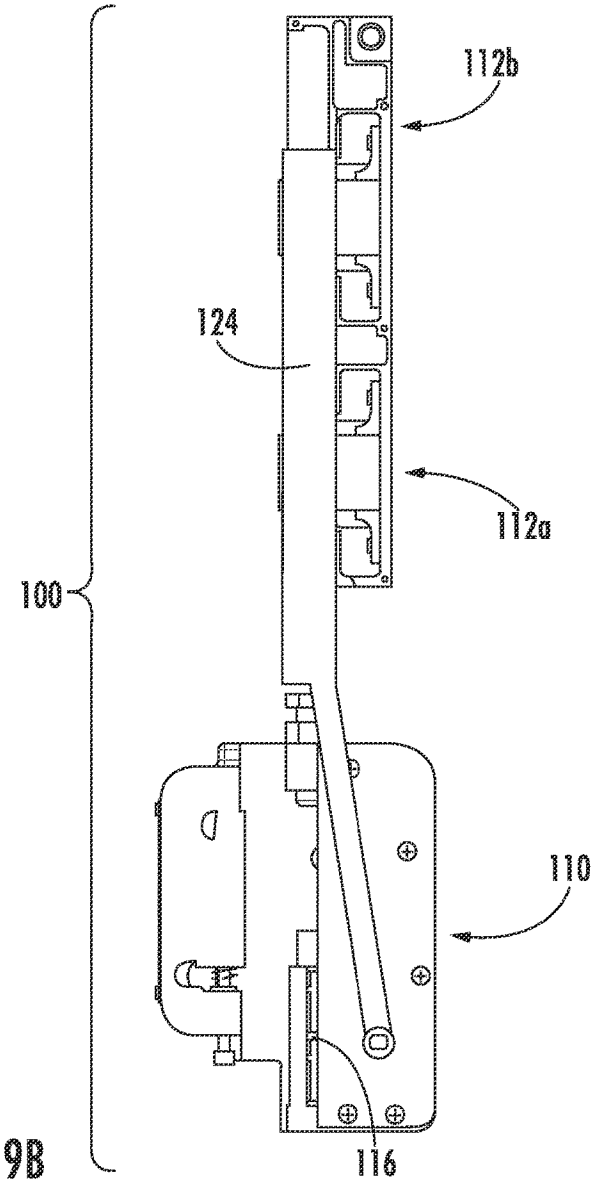
FIG. 9B is a side view of the electronic safety actuation device of FIG. 9A according to an embodiment.
Figure 9A:
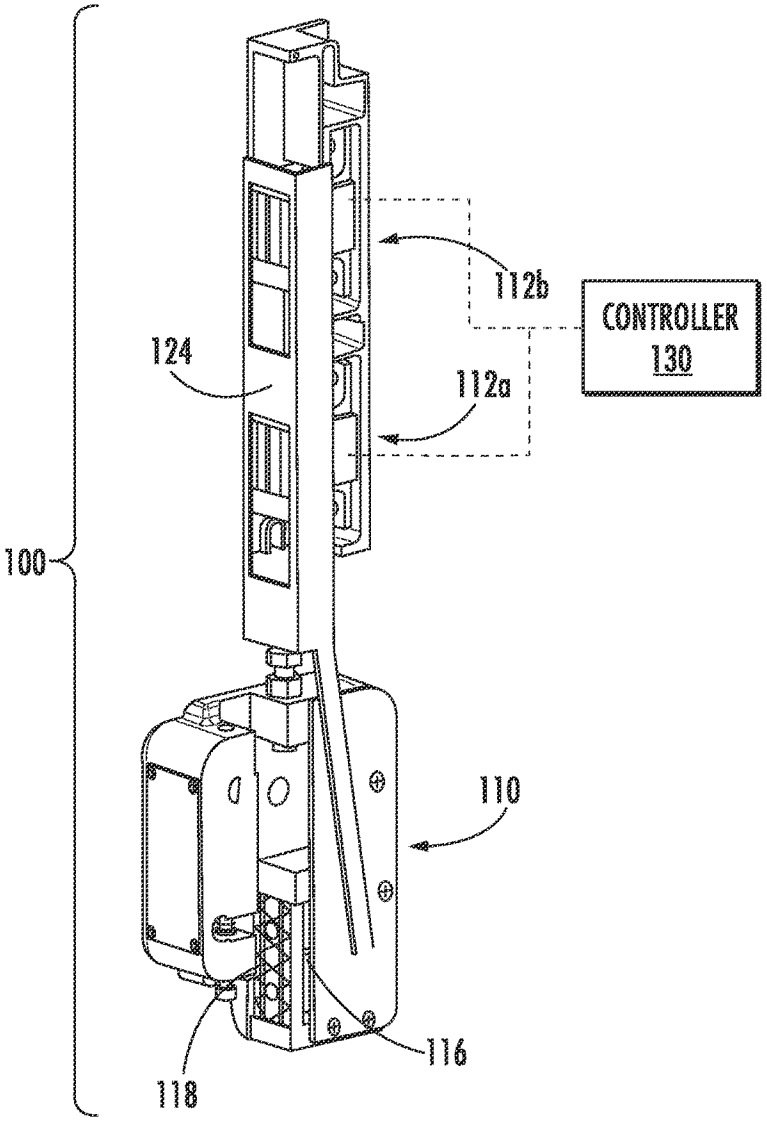
FIG. 9A is a perspective view of an electronic safety actuation device including multiple electronic safety actuators according to an embodiment.

Each of the plurality of electronic safety actuators 112*a*, 112*b* is coupled to the safety brake 110 and is operable to transform the brake 110 between a non-braking position and a braking position. Accordingly, each of the electronic safety actuators 112*a*, 112*b* typically includes a separate link member 124. However, in an embodiment, such as shown in FIGS. 9A and 9B the link members 124 may be integrally formed. In the embodiment of FIGS. 9A and 9B, the singular link member 124 sheet metal linkage having a plurality of windows formed therein. Each window is associated with a corresponding safety actuator 112.

Figure 5:
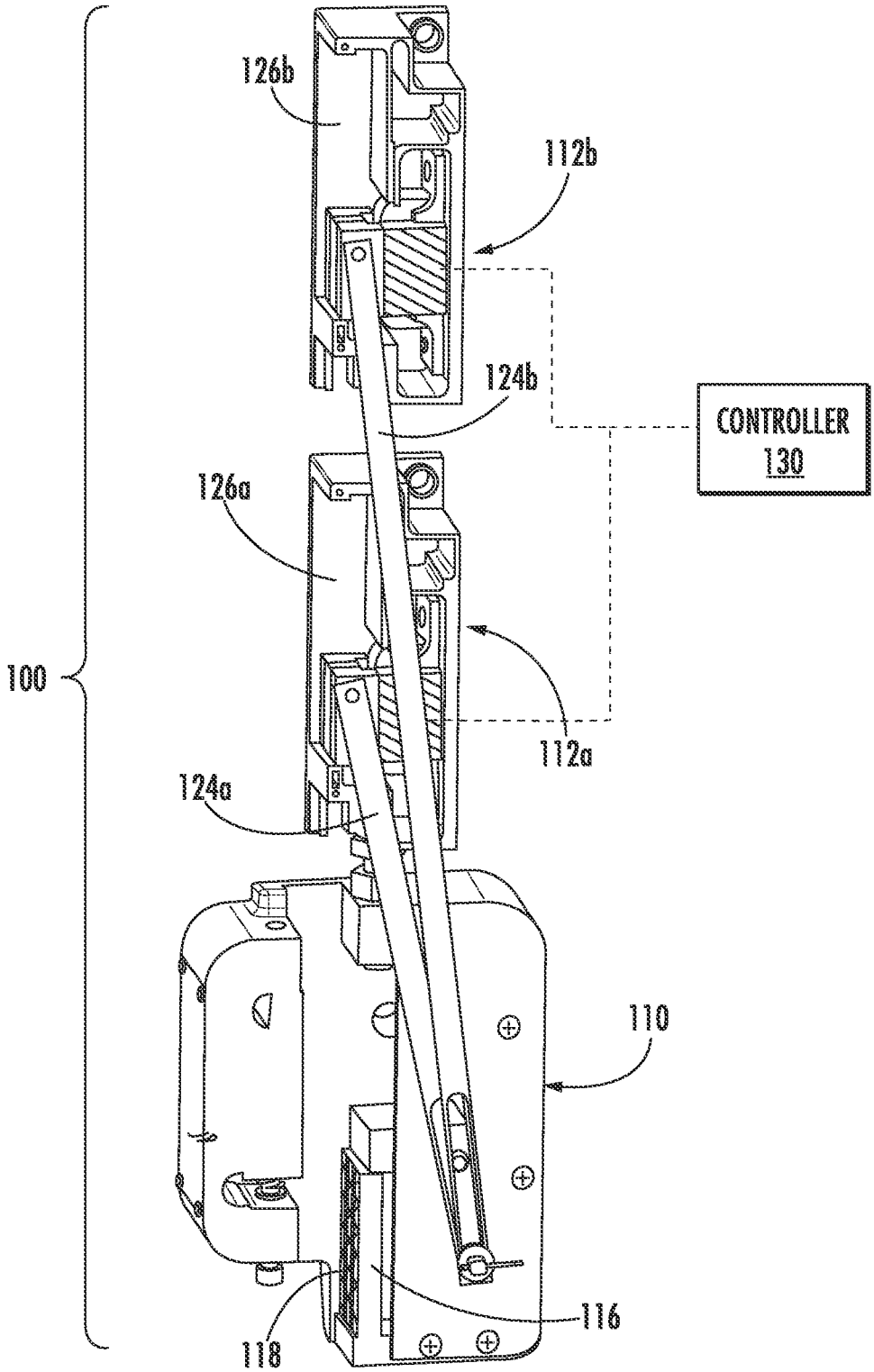
FIG. 5 is a perspective view of an electronic safety actuation device including multiple electronic safety actuators according to an embodiment.
Figure 6:
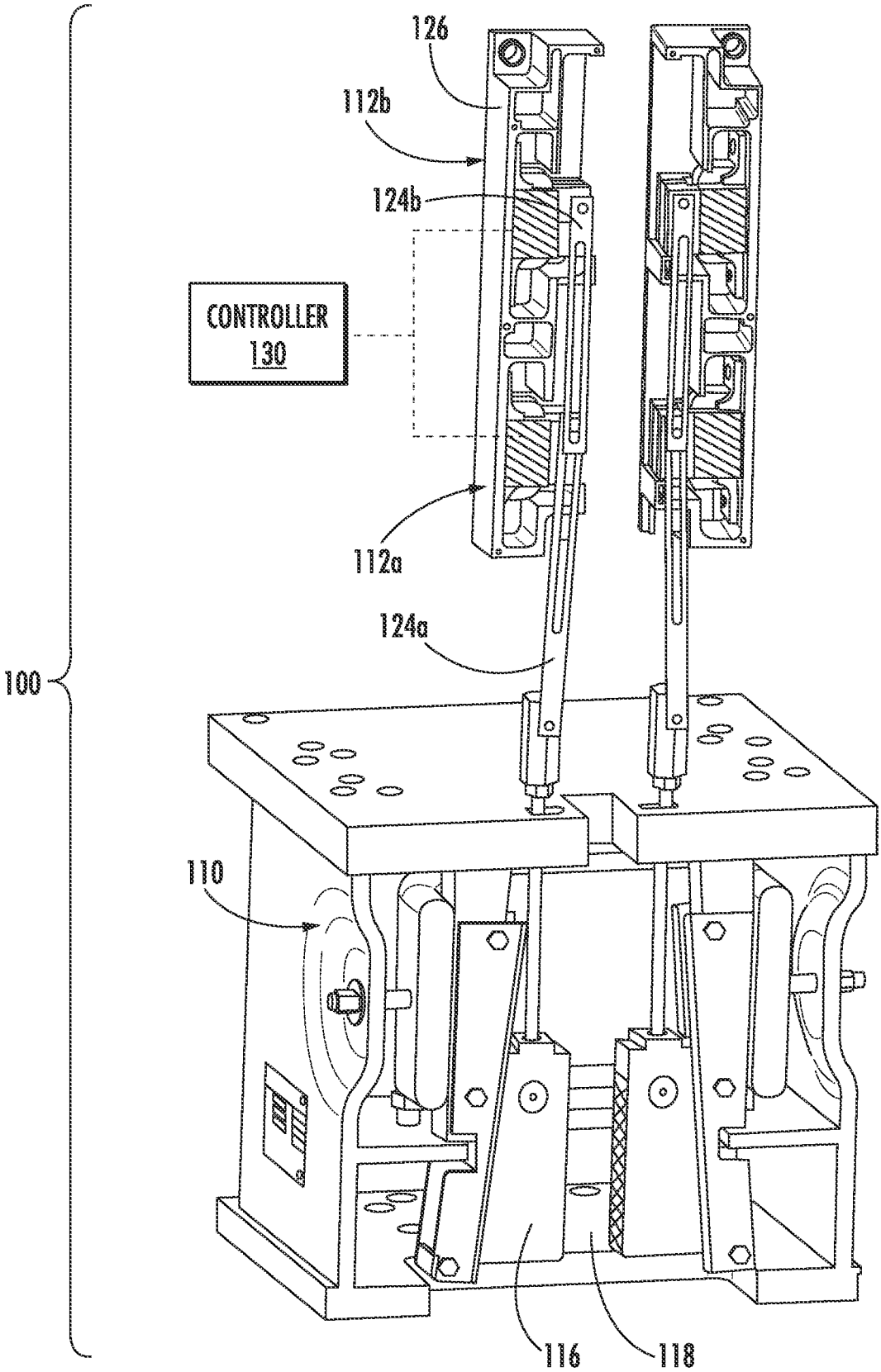
FIG. 6 is a perspective view of an electronic safety actuation device including multiple electronic safety actuators according to an embodiment.

As best shown in FIGS. 4, 5, and 8, each of the safety actuators 112 may include a link member 124*a*, 124*b* that is individually coupled to the safety brake 110. However, in other embodiments, the link members 124*a*, 124*b* associated with each of the safety actuators 112*a*, 112*b* may be interconnected, such that one of the link members 124 provides an intermediate connection between another link member 124 and the safety brake 110. For example, with reference to FIGS. 6 and 7, the link member 124*a* associated with a first electronic safety actuator 112*a* may be directly coupled to the safety brake 110, and the link member 124*b* associated with a second electronic safety actuator 112*b* may be coupled to the first link member 124*a*. Application of a force to the second link member 124*a* results in a movement of the first link member 124*a*, which ultimately triggers a corresponding movement of the brake member 116 of the safety brake 110 from the non-braking position to the braking position. However, it should be understood that any suitable connection between the plurality of link members 124 is contemplated herein.

Figure 7:
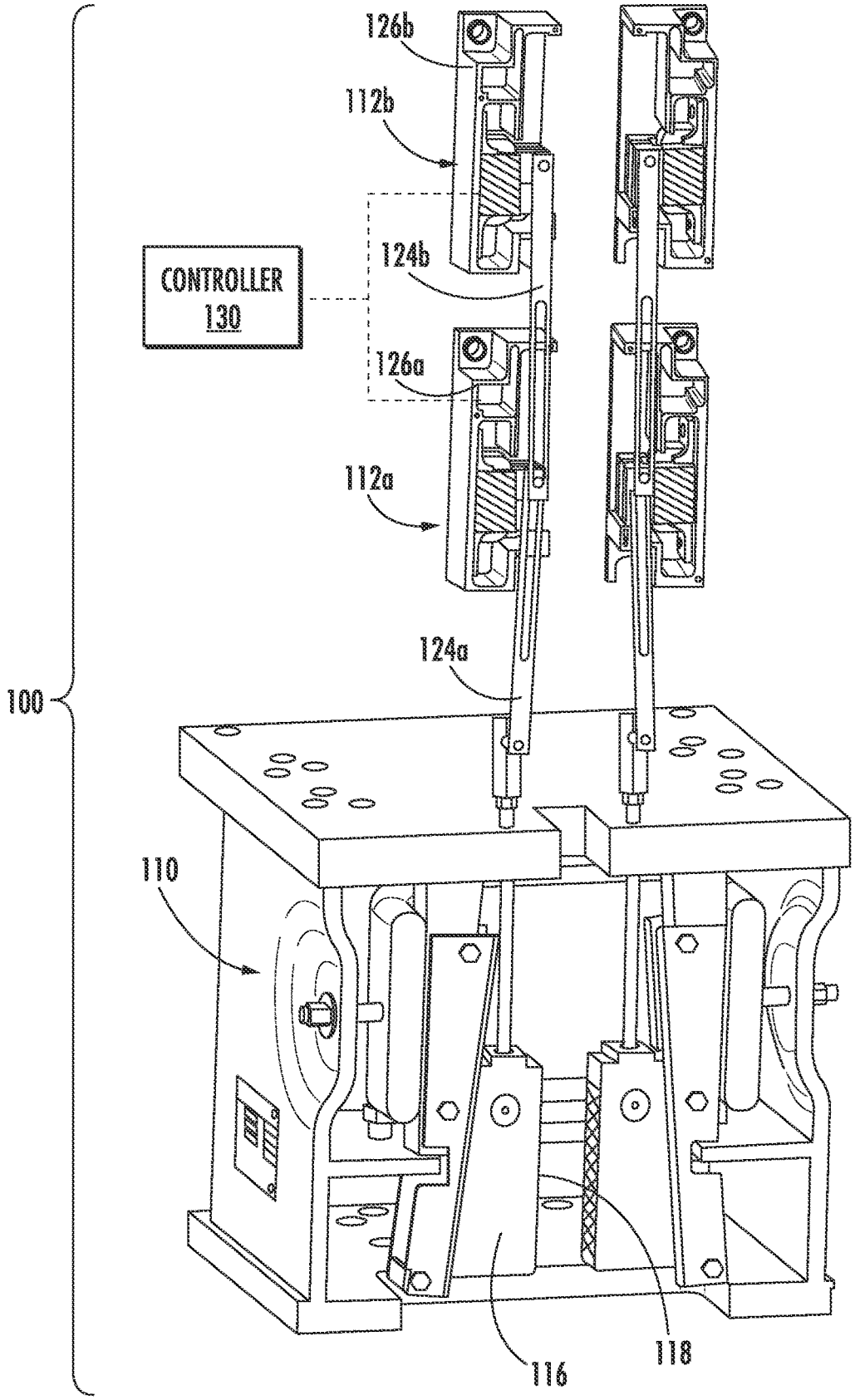
FIG. 7 is a perspective view of an electronic safety actuation device including multiple electronic safety actuators according to an embodiment.
Figure 8:
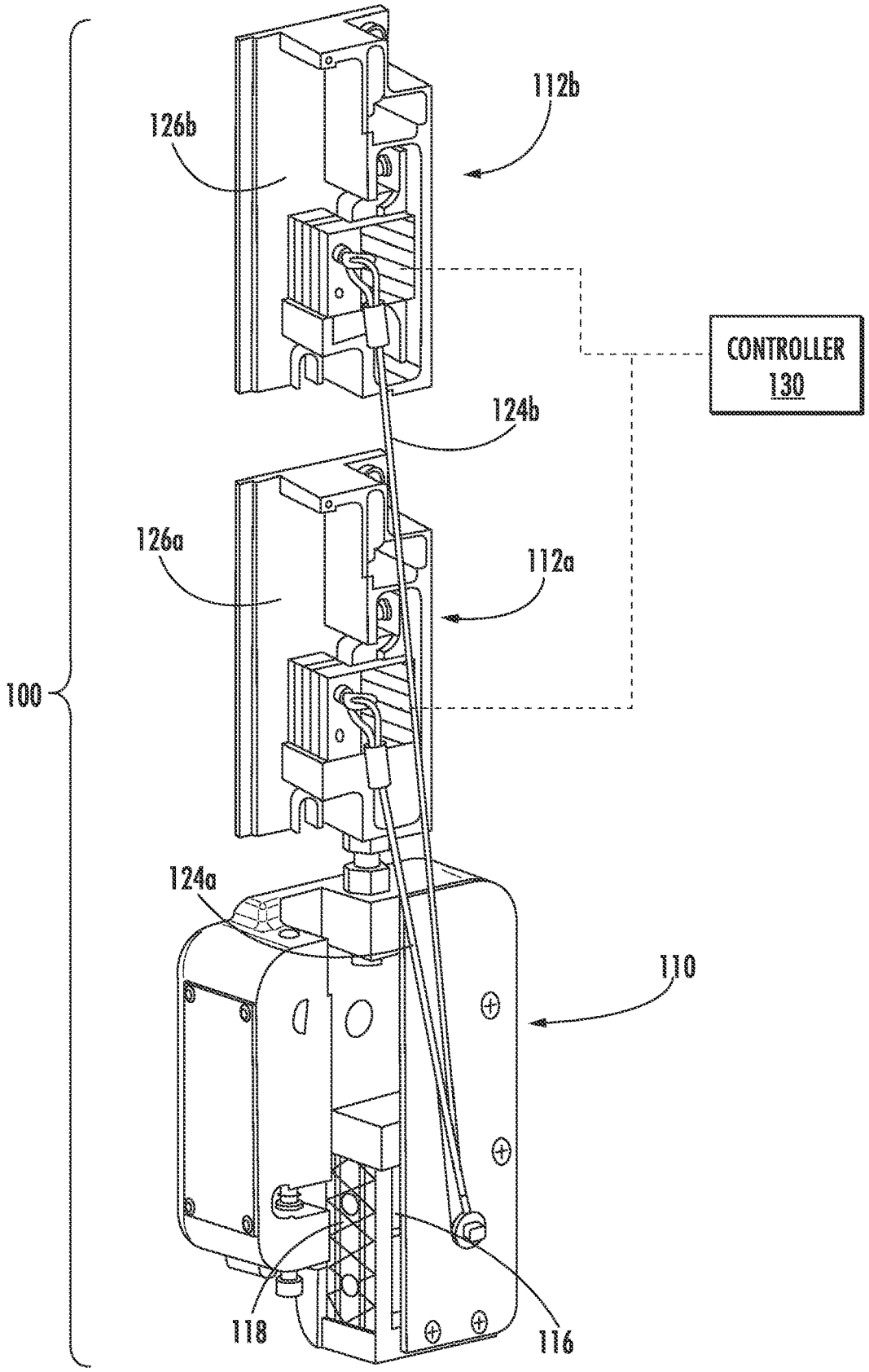
FIG. 8 is a perspective view of an electronic safety actuation device including multiple electronic safety actuators according to an embodiment.

In the illustrated, non-limiting embodiment of FIGS. 6 and 7, the first link member 124*a* and the second link member 124*b* are slidably coupled to one another, such as via a pin and slot engagement. As shown, each of the link members 124*a*, 124*b* has an elongated slot formed therein, and a pin extends through both elongated slots to couple the link members 124*a*, 124*b*. Through this engagement, the first, intermediate link member 124*a* is able to apply a force to the safety brake 110 by moving the link member 124*b* relative to the second link member 124. Alternatively, the second link member 124*b* is able to apply a force to the safety brake by exerting an upward force on the second link member 124*b*. The upward force is transmitted to the safety brake 110 through a corresponding movement of the first, intermediate link member 124*a*. With respect to FIGS. 9A and 9B, alternatively, actuation of the permanent magnet assembly of either safety actuator would result in translational movement of the link member 124 relative to the safety brake 110.

By coupling multiple safety actuators 112 to a single safety brake 110, each of the safety actuators 112 is able to initiate movement of the brake 110, thereby providing redundancy to the system in the event of a failure. Further, the interface must be designed to allow each actuator to move independently with respect to the other actuator so as not to prevent actuation of the safety brake 110. Providing a single interface between multiple actuators 112 and the safety brake 110, thereby reduces the complexity of the interface.

During an overspeed condition, or another condition of the elevator system 20 requiring braking, a signal may be transmitted to a controller, illustrated schematically at 130, associated with one or more of the plurality of electronic safety actuators 112*a*, 112*b*. Alternatively, in an embodiment, the controller 130 may itself sense the overspeed condition or the condition requiring braking. In response to the signal, the controller 130 will actuate the electromagnetic component 120 of the first electronic safety actuator 112*a*. In the event that the electronic safety actuator 112*a* fails, the controller 130 will then actuate the electromagnetic component 120 of the second electronic safety actuator 112*b*. Alternatively, in response to receiving a signal, the controller 130 may operate the electromagnetic component 120 of more than one of the plurality of electronic safety actuators 112*a*, 112*b* simultaneously.

A safety actuation device 100 including a plurality of electronic safety actuators 112 coupled to a single safety brake 110 has improved reliability compared to existing systems. One or more of the safety actuators 112 provides redundancy in the event of a failure of another of the plurality of electronic safety actuators 112.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An electronic safety actuation device for braking an elevator car comprising:

a safety brake having a movable member movable between a non-braking position and a braking position;

a first electronic safety actuator operably coupled to the movable member of the safety brake via a first link member;

a second electronic safety actuator operably coupled to the movable member of the safety brake via a second link member;

wherein operation of the first electronic safety actuator applies a force to the first link member to move the movable member from the non-braking position to the braking position and operation of the second electronic safety actuator applies a force to the second link member to move the movable member from the non-braking position to the braking position.

2. The electronic safety actuation device of claim 1, wherein the second link member is coupled to the safety brake via the first link member.

3. The electronic safety actuation device of claim 2, wherein the first link member and the second link member are connected via a pin and slot engagement.

4. The electronic safety actuation device of claim 2, wherein the first link member is movable relative to the second link member to move the safety brake from the non-braking position to the braking position.

5. The electronic safety actuation device of claim 2, wherein the second link member is configured to move in conjunction with the first link member to move the safety brake from the non-braking position to the braking position.

6. The electronic safety actuation device of claim 1, wherein the first electronic safety actuator and the second electronic safety actuator are integrally formed as a single unit.

7. The electronic safety actuation device of claim 1, wherein the first electronic safety actuator includes a first housing and the second electronic safety actuator includes a second housing, separate from the first housing.

8. The electronic safety actuation device of claim 1, wherein the first electronic safety actuator further comprises:

a magnetic brake operably coupled to the first link member, the magnetic brake being movable between a first position and a second position; and an electromagnetic component configured to hold the magnetic brake in one of the first position and the second position.

9. The electronic safety actuation device of claim 1, wherein the safety brake includes a wedge having a contact surface, the wedge being movable between the non-braking position and the braking position.

10. An electronic safety actuation device for braking an elevator car comprising:

a safety brake movable between a non-braking position and a braking position;

a first electronic safety actuator operably coupled to the safety brake via a first link member;

a second electronic safety actuator including a second link member, the second link member being operably coupled to the safety brake via the first link member;

wherein operation of the first electronic safety actuator applies a force to the first link member to move the safety brake from the non-braking position to the braking position and operation of the second electronic safety actuator applies a force to the second link member to move the safety brake from the non-braking position to the braking position.

* * * * *